US008412082B2

(12) United States Patent
Yagi et al.

(10) Patent No.: US 8,412,082 B2
(45) Date of Patent: Apr. 2, 2013

(54) CONVEYING DEVICE, FIXING DEVICE AND IMAGE FORMING APPARATUS HAVING RESTRICTING MEMBER

(75) Inventors: Motoyuki Yagi, Kanagawa (JP); Yukihiro Ichiki, Kanagawa (JP); Takayuki Yamada, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 288 days.

(21) Appl. No.: 12/875,593

(22) Filed: Sep. 3, 2010

(65) Prior Publication Data

US 2011/0236087 A1 Sep. 29, 2011

(30) Foreign Application Priority Data

Mar. 25, 2010 (JP) ..... 2010-070332

(51) Int. Cl.
*G03G 15/20* (2006.01)

(52) U.S. Cl. ..... 399/329

(58) Field of Classification Search ..... 399/329, 399/328

See application file for complete search history.

(56) References Cited

U.S. PATENT DOCUMENTS

2004/0120740 A1 * 6/2004 Uekawa et al. ..... 399/329

FOREIGN PATENT DOCUMENTS

JP 07036297 A * 2/1995
JP 2001-117395 A 4/2001
JP 2003195664 A * 7/2003

* cited by examiner

*Primary Examiner* — Quana M Grainger
(74) *Attorney, Agent, or Firm* — Sughrue Mion, PLLC

(57) ABSTRACT

A conveying device including: a rotating body that rotates; a conveying belt that rotates while nipping a conveyed member between the conveying belt and the rotating body, thereby conveying the conveyed member; a pressing member that is disposed at an inner periphery of the conveying belt along a conveying belt rotation axis direction and presses the conveying belt towards the rotating body; a pair of support members that are respectively disposed at each of two rotation axis direction edge sides of the conveying belt and that support the pressing member; and a contact member that is disposed at the inner periphery of the conveying belt along the conveying belt rotation axis direction, makes sliding contact with the rotating conveying belt, and is supported so as to be independently displaceable relative to the pressing member.

6 Claims, 7 Drawing Sheets

CONVEYING DEVICE, FIXING DEVICE AND IMAGE FORMING APPARATUS HAVING RESTRICTING MEMBER

CROSS-REFERENCE TO RELATED APPLICATION

This application is based on and claims priority under 35 USC 119 from Japanese Patent Application No. 2010-070332 filed on Mar. 25, 2010.

BACKGROUND

Technical Field

The present invention relates to a conveying device, a fixing device, and an image forming apparatus.

SUMMARY

A first aspect of the present invention is a conveying device including: a rotating body that rotates; a conveying belt that rotates while nipping a conveyed member between the conveying belt and the rotating body, thereby conveying the conveyed member; a pressing member that is disposed at an inner periphery of the conveying belt along a conveying belt rotation axis direction and presses the conveying belt towards the rotating body; a pair of support members that are respectively disposed at each of two rotation axis direction edge sides of the conveying belt and that support the pressing member; and a contact member that is disposed at the inner periphery of the conveying belt along the conveying belt rotation axis direction, makes sliding contact with the rotating conveying belt, and is supported so as to be independently displaceable relative to the pressing member.

BRIEF DESCRIPTION OF THE DRAWINGS

Exemplary embodiments of the present invention will be described in detail based on the following figures, wherein.

DETAILED DESCRIPTION

Explanation follows of an exemplary embodiment according to the present invention, based on the figures.

Figure 1:
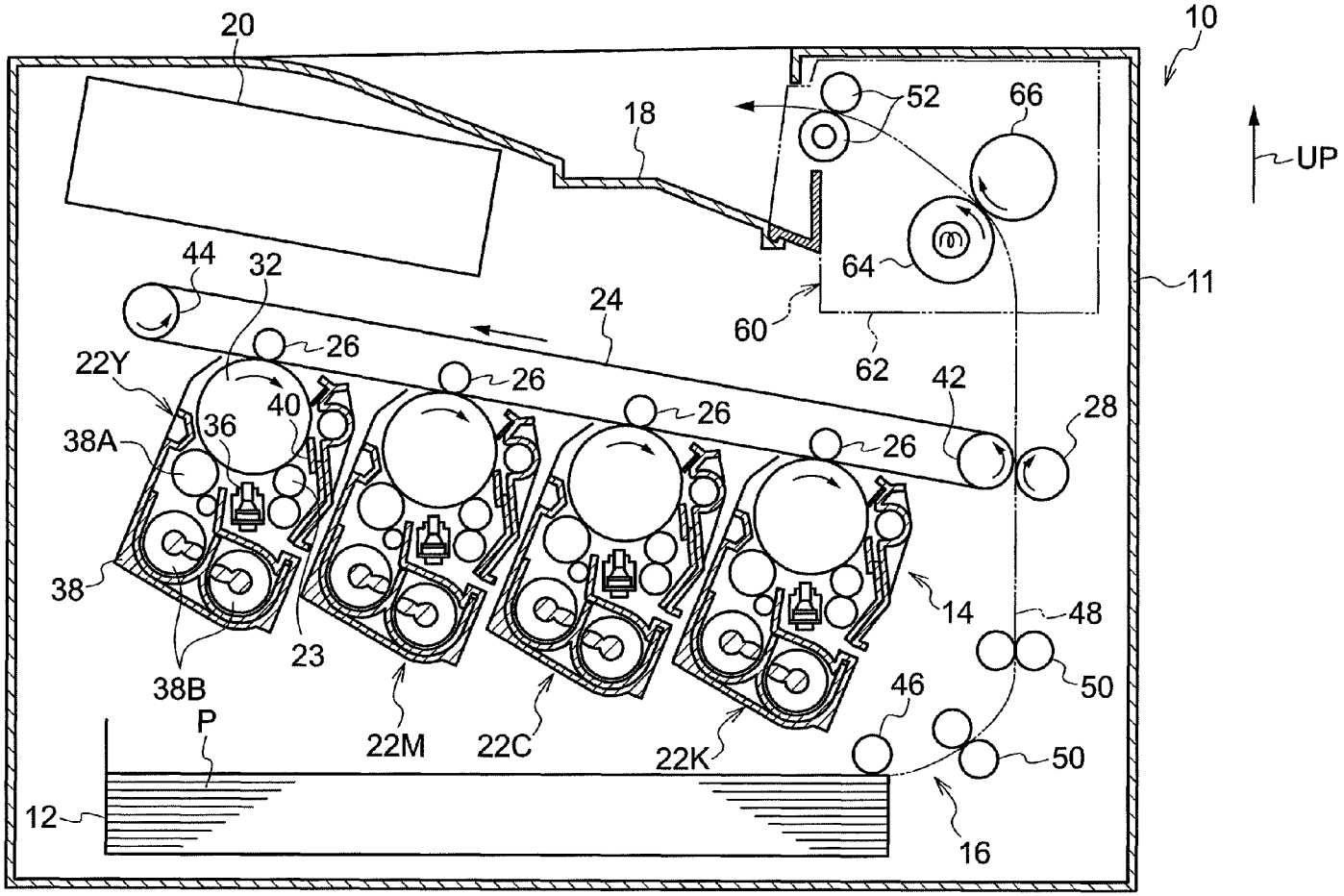
FIG. 1 is a schematic diagram showing a configuration of an image forming apparatus according to the present exemplary embodiment.

Configuration of an Image Forming Apparatus According to the Present Exemplary Embodiment First, explanation follows of a configuration of an image forming apparatus according to the present exemplary embodiment. FIG. 1 is a schematic diagram showing a configuration of an image forming apparatus according to the present exemplary embodiment. In the drawing the direction of arrow UP indicates the upwards vertical direction.

An image forming apparatus 10, as shown in FIG. 1, is equipped with an image forming apparatus body 11 in which various configuration components are internally housed. Inside the image forming apparatus body 11 are provided: a housing section 12 in which a recording medium P, such as, for example, paper, is housed; an image forming section 14 that forms an image on the recording medium P; a conveying section 16 that conveys the recording medium P from the housing section 12 to the image forming section 14; and a controller 20 that controls the operation of each section of the image forming apparatus 10. A discharge section 18 is provided at an upper portion of the image forming apparatus body 11, into which is discharged the recording medium P formed with an image by the image forming section 14.

The image forming section 14 includes: image forming units 22Y, 22M, 22C, 22K (referred to below as 22Y to 22K) that form toner images of each of the colors yellow (Y), magenta (M), cyan (C) and black (K), respectively; an intermediate transfer belt 24 onto which the toner images formed at the image forming units 22Y to 22K are transferred; primary transfer rolls 26 that transfer onto the intermediate transfer belt 24 the toner images that have been formed on the image forming units 22Y to 22K; and a secondary transfer roll 28 that transfers the toner images transferred onto the intermediate transfer belt 24 by the primary transfer rolls 26, from the intermediate transfer belt 24 onto the recording medium P. The image forming section 14 is not limited to the configuration described above, and any other configuration that forms an image on the recording medium P may be adopted.

The image forming units 22Y to 22K are disposed in a row at a top-bottom direction central portion of the image forming apparatus 10, the row being at an angle inclined to the horizontal direction. Each of the image forming units 22Y to 22K has a respective photoreceptor 32 that rotates in one direction (for example, the clockwise direction in FIG. 1). Since the image forming units 22Y to 22K are each of a similar configuration to each other, reference numbers for each of the components of the image forming units 22M, 22C and 22K are omitted in FIG. 1.

Around the periphery of each of the photoreceptors 32 are provided, in sequence from the photoreceptor 32 rotation direction upstream side: a charging roll 23, serving as an example of a charging device, that charges the photoreceptor 32; an exposing device 36 that light-exposes the photoreceptor 32 that has been charged by the charging roll 23, thereby forming an electrostatic latent image on the photoreceptor 32; a developing device 38 that develops the electrostatic latent image formed on the photoreceptor 32 by the exposing device 36 and forms a toner image; and a cleaning member 40 that contacts the photoreceptor 32 and cleans off any toner remaining on the photoreceptor 32.

The exposing device 36 forms an electrostatic latent image based on an image signal transmitted from the controller 20. As an image signal transmitted from the controller 20 there is, for example, an image signal the controller 20 has acquired from an external device.

The developing device 38 includes a developer supply body 38A that supplies a developer onto the photoreceptor 32, and plural conveying members 38B that convey, while stirring, the developer for application onto the developer supply body 38A.

The intermediate transfer belt 24 is formed in a loop shape disposed above the image forming units 22Y to 22K. Entraining rolls 42, 44 are provided at the inner peripheral side of the intermediate transfer belt 24, with the intermediate transfer belt 24 entrained around the entraining rolls 42, 44. The intermediate transfer belt 24 is configured so as to perform circulatory movement (rotation) in one direction (for example, the anticlockwise direction in FIG. 1) while making contact with the photoreceptors 32, due to one or other of the entraining rolls 42, 44 being rotationally driven. The entraining roll 42 is a facing roll that faces the secondary transfer roll 28.

Each of the primary transfer rolls 26 faces the respective photoreceptor 32, with the intermediate transfer belt 24 nipped therebetween. Primary transfer positions are formed between the primary transfer rolls 26 and the photoreceptors 32, with the toner image formed on each of the photoreceptors 32 transferred onto the intermediate transfer belt 24 at these primary transfer positions.

The secondary transfer roll 28 faces the entraining roll 42, with the intermediate transfer belt 24 nipped therebetween. A secondary transfer position is formed between the secondary transfer roll 28 and the entraining roll 42, with the toner images formed on the intermediate transfer belt 24 transferred onto the recording medium P at this secondary transfer position.

The conveying section 16 includes: a feed roll 46 that feeds out recording medium P housed in the housing section 12; a conveying path 48 along which is conveyed the recording medium P that has been fed out by the feed roll 46; plural conveying rolls 50 disposed along the conveying path 48 and conveying the recording medium P fed out by the feed roll 46 to the secondary transfer position.

A fixing device 60, serving as an example of a conveying device for conveying the recording medium P (serving as an example of a conveyed member), is provided further to the conveying direction downstream side than the secondary transfer position, the fixing device 60 fixing onto the recording medium P the toner images that were transferred onto the recording medium P by the secondary transfer roll 28. Discharge rolls 52 are provided to the fixing device 60 for discharging the recording medium P fixed with the toner images into the discharge section 18. A specific configuration of the fixing device 60 is described below.

Next, explanation follows regarding an image forming operation, for forming an image on the recording medium P, in the image forming apparatus 10 according to the present exemplary embodiment.

In the image forming apparatus 10 according to the present exemplary embodiment, the recording medium P fed out from the housing section 12 by the feed roll 46 is fed into the secondary transfer position by the plural conveying rolls 50.

In the image forming units 22Y to 22K, the photoreceptors 32 that have been charged by the charging rolls 23 are exposed by the exposing devices 36, whereby electrostatic latent images are formed on the photoreceptors 32. Toner images are formed on the photoreceptor 32 by development of the electrostatic latent images with the developing devices 38. The toner images of each of the respective colors formed on the image forming units 22Y to 22K are superimposed onto the intermediate transfer belt 24 at the primary transfer positions, thereby forming a full color image. The full color image formed on the intermediate transfer belt 24 is then transferred onto the recording medium P at the secondary transfer position.

The recording medium P onto which the toner image has been transferred is conveyed to the fixing device 60, and the transferred toner image is fixed by the fixing device 60. The recording medium P to which the toner image is fixed is discharged into the discharge section 18 by the discharge rolls 52. A cycle of image forming operation is performed as described above.

Figure 2:
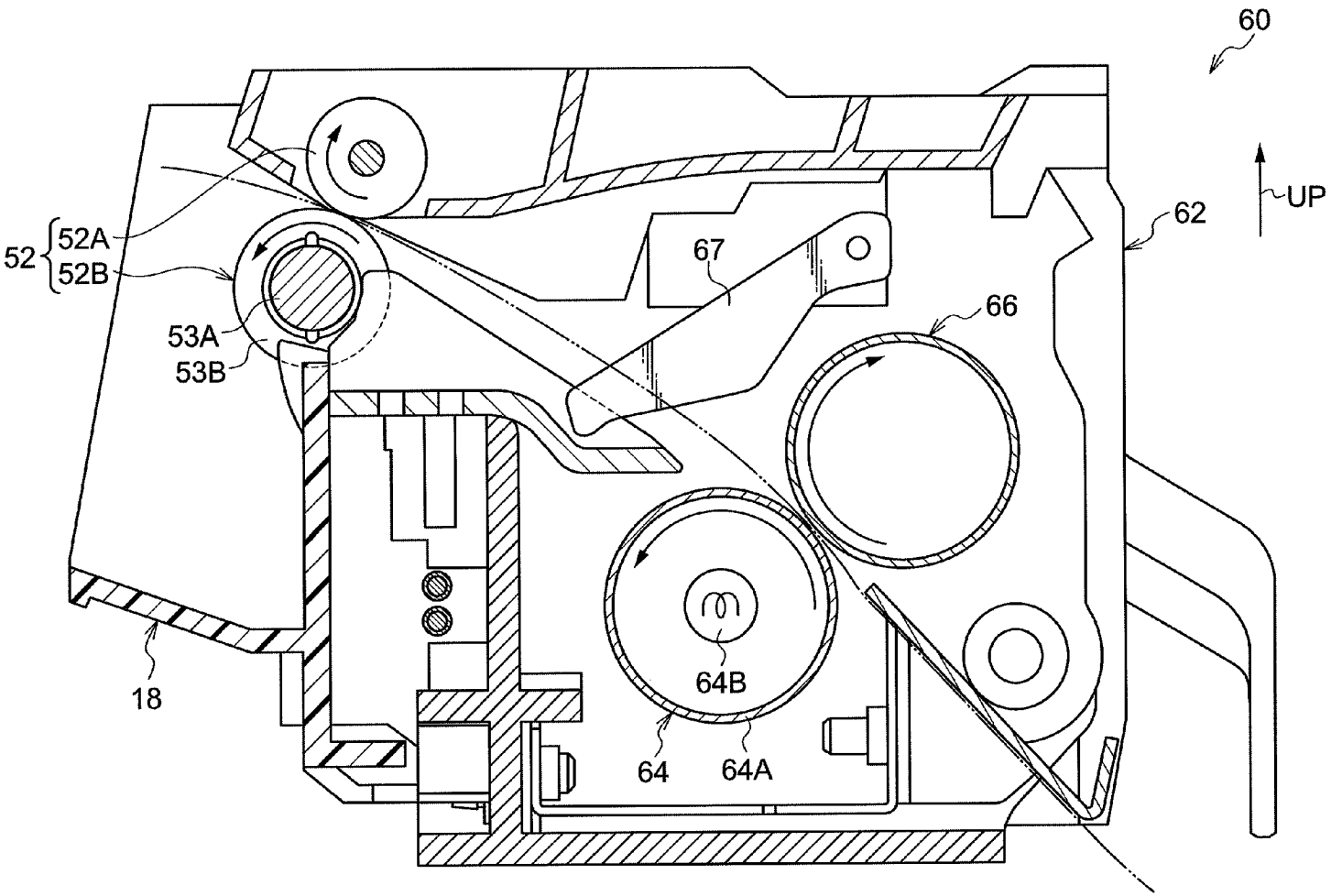
FIG. 2 is a cross-section showing a configuration of a fixing device according to the present exemplary embodiment.

Configuration of the Fixing Device 60 According to the Present Exemplary Embodiment Next, explanation follows of a configuration of the fixing device 60 according to the present exemplary embodiment. FIG. 2 is a schematic diagram showing a configuration of the fixing device 60 according to the present exemplary embodiment. The arrow UP in the drawing indicates the upwards vertical direction.

The fixing device 60 according to the present exemplary embodiment, as shown in FIG. 2, is equipped with a fixing device body 62, detachably mounted to the image forming apparatus body 11, with various configuring components provided in the fixing device body 62. In the fixing device body 62 are provided a heating roll 64, serving as an example of a rotating body that rotates, and a pressure belt 66, serving as an example of a loop shaped conveying belt that rotates while nipping a recording medium P (an example of a conveyed member) between itself and the heating roll 64, conveying the recording medium P.

On the conveyed recording medium P, nipped by the heating roll 64 and the pressure belt 66, the toner on the recording medium P is subjected to heating by the heating roll 64, and the toner on the recording medium P is subjected to application of pressure by the pressure belt 66, such that the image is fixed in the contact region of the heating roll 64 and the pressure belt 66. A specific configuration of the heating roll 64 and the pressure belt 66, and the support structure of the heating roll 64 and the pressure belt 66 are described below.

In the fixing device body 62, the pair of discharge rolls 52 is provided for discharging from the fixing device body 62 the recording medium P, to which the toner image has been fixed by the heating roll 64 and the pressure belt 66, into the discharge section 18. The pair of discharge rolls 52 is configured with a following roll 52A and a drive roll 52B disposed at the lower side of the following roll 52A. The drive roll 52B is configured with a drive shaft 53A and a roll section 53B provided to the drive shaft 53A. A portion of the discharge section 18 is formed in the fixing device body 62.

In FIG. 2, the conveying path along which the recording medium P is conveyed, by the pair of discharge rolls 52 and the heating roll 64 and the pressure belt 66, is shown by a double-dotted dashed line. A detection flipper 67, serving as an example of a detection portion for detecting the recording medium P, is provided on the conveying path, between the heating roll 64-pressure belt 66 and the pair of discharge rolls 52.

Explanation follows regarding a specific configuration of the heating roll 64 and the pressure belt 66, and a support structure of the heating roll 64 and the pressure belt 66.

The heating roll 64 is configured including a cylindrical shaped circular cylinder member 64A, and a heating source 64B, such as, for example, a halogen lamp, provided within the hollow space within the circular cylinder member 64A.

Figure 3:
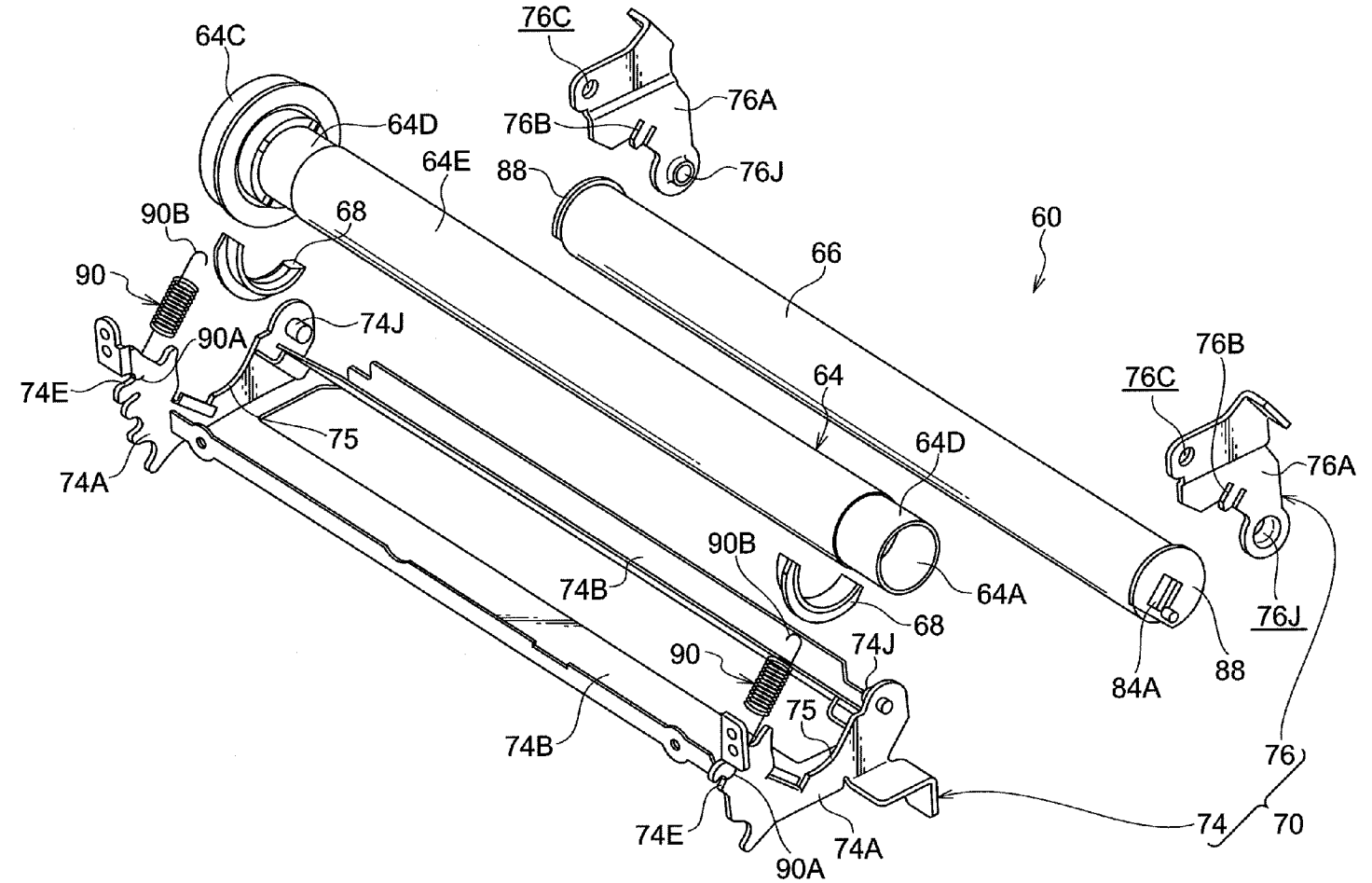
FIG. 3 is an exploded perspective view showing a heating roll and a pressure belt, and a support structure thereof, according to the present exemplary embodiment.
Figure 4:
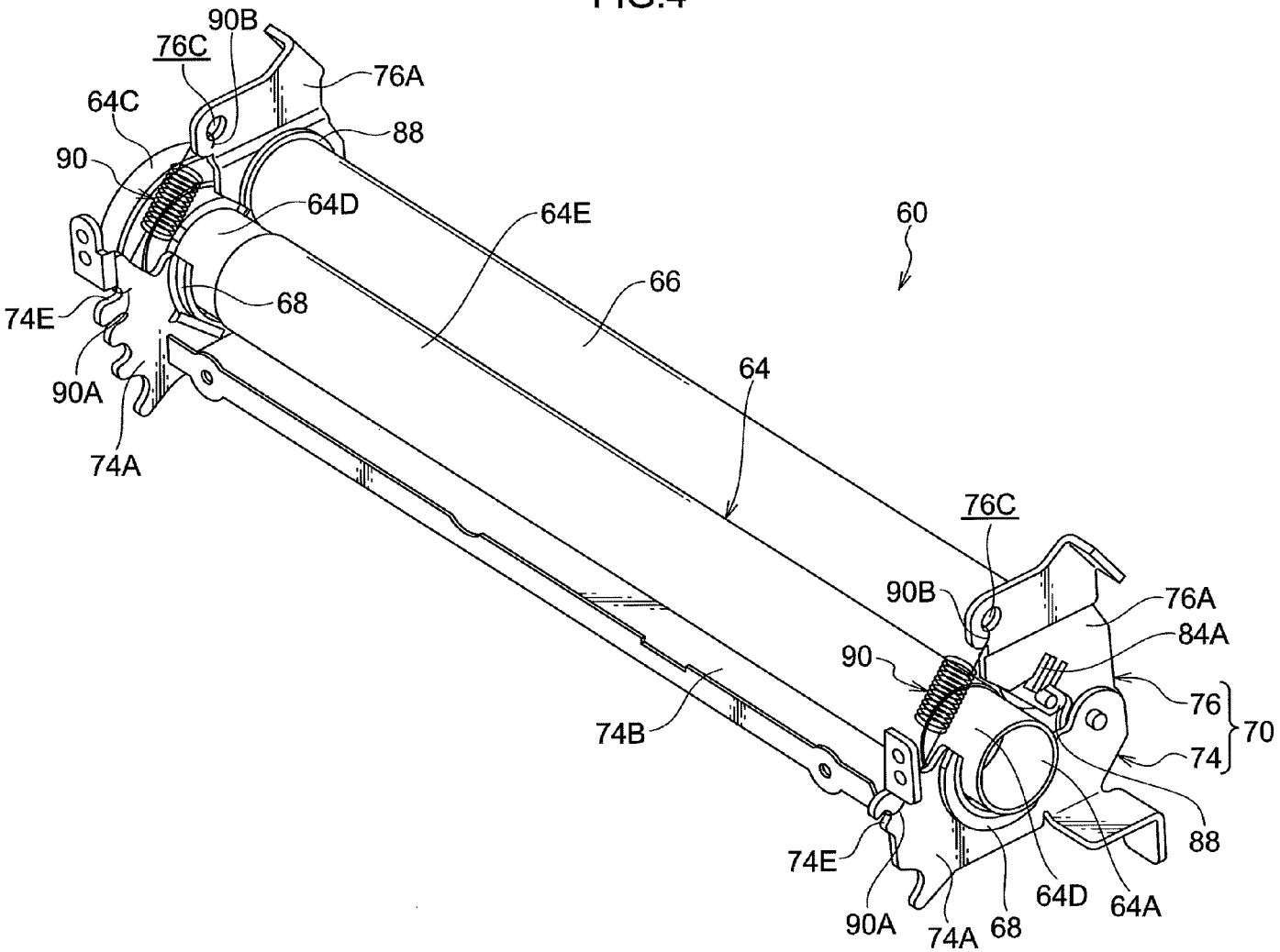
FIG. 4 is a perspective view showing a heating roll and a pressure belt, and a support structure thereof, according to the present exemplary embodiment.

The circular cylinder member 64A is formed from a metal material, such as, for example, aluminum, stainless steel or the like. A gear 64C is attached at one axial direction end portion of the circular cylinder member 64A, as shown in FIG. 3 and FIG. 4, for transmitting rotation force from a drive motor to the circular cylinder member 64A.

The two axial direction end portions of the circular cylinder member 64A configure supported portions 64D that are supported on slide bearings 68, described below. At one axial direction end of the circular cylinder member 64A, at the side where the gear 64C is disposed, the supported portion 64D is disposed further to the axial direction center than the position at which the gear 64C is attached.

A cover member 64E is provided so as to cover the outer peripheral surface of the circular cylinder member 64A between the supported portions 64D at the two axial direction ends of the circular cylinder member 64A. The cover member 64E is formed from a resilient material, such as, for example, rubber.

A support body 70 is provided in the fixing device body 62 for supporting the heating roll 64 and the pressure belt 66. The support body 70 is configured including a roll support member 74 for supporting the heating roll 64, and a belt support member 76 for supporting the pressure belt 66.

The roll support member 74 is configured including a pair of side plates 74A (serving as an example of a pair of support members) disposed at the two axial direction ends of the heating roll 64, respectively, and supporting a pressing member 80, described below, and a coupling plate 74B that is disposed between the pair of side plates 74A and couples the pair of side plates 74A together.

A recess 75 is formed in each of pair of side plates 74A, cutout in a circular arc shape. The slide bearings 68 that are formed in a circular arc shape to follow the recesses 75 are each attached to the pair of side plates 74A, respectively. The slide bearings 68 rotatably support the supported portions 64D of the circular cylinder member 64A.

Shaft portions 74J, serving as examples of support portions, are provided at one end portion of each of the pair of side plates 74A (the right hand end portion in FIG. 3 and FIG. 4) for rotatably supporting the belt support member 76.

Attachment portions 74E are provided at portions at the other end (the left hand end portion in FIG. 3 and FIG. 4) of each of the pair of respective side plates 74A. One end of respective tension springs 90, serving as examples of resilient members, is attached to the attachment portions 74E. Specifically, the attachment portions 74E are configured as recesses formed in the pair of side plates 74A. One of the ends of each of the tension springs 90 is formed into a hook 90A so as to hook onto respective attachment portion 74E configured as a recess portion.

The belt support member 76 is configured with a pair of side plates 76A disposed at both axial direction edges of the pressure belt 66. Supported holes 76J, serving as examples of supported portions supported by the shaft portions 74J of the pair of side plates 74A of the roll support member 74, are formed in portions at one end (end portions at the right hand bottom side in FIG. 3) of the pair of side plates 76A, respectively. The pair of side plates 76A are respectively supported, rotatable about the axis of the shaft portions 74J relative to the pair of side plates 74A of the roll support member 74, by the shaft portions 74J fitting into the supported holes 76J.

Attachment portions 76C are respectively provided at portions at the other end of the pair of side plates 76A (end portions the left hand top side in FIG. 3), and the portions at the other ends of the respective tension springs 90 are attached to the attachment portions 76C. The attachment portions 76C are, specifically, configured as through holes passing through the pair of side plates 76A. Configuration is made such that hooks 90B formed in the other end portions of the tension springs 90 are hooked into the attachment portions 76C configured as through holes.

Projection portions 84A of a plate body 84, described below, are respectively insertable from the left hand bottom side in FIG. 3 into insertion grooves 76B formed in the pair of side plates 76A.

Figure 5:
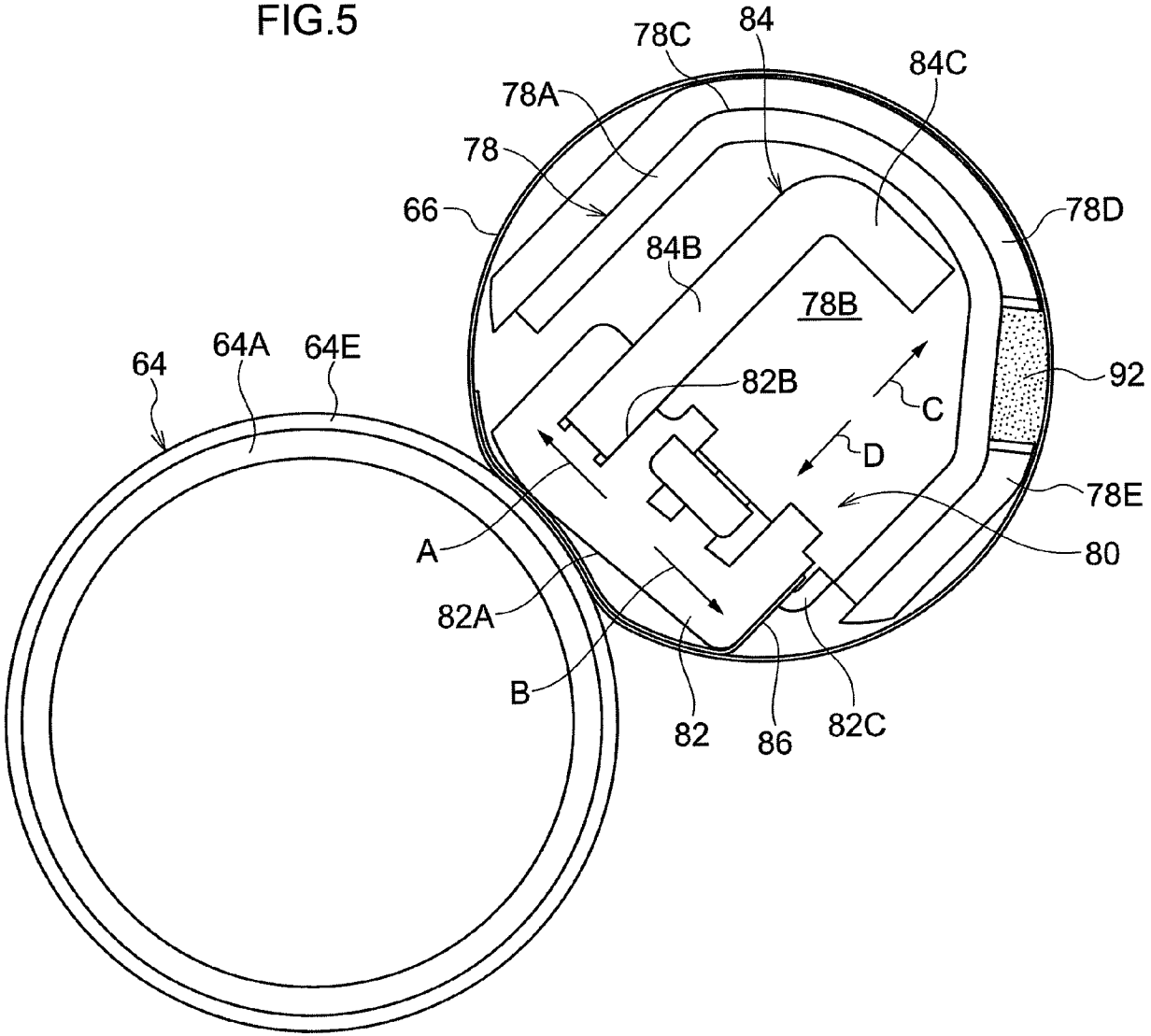
FIG. 5 is a lateral cross-section of a heating roll and a pressure belt according to the present exemplary embodiment.

As shown in FIG. 5, a pressing member 80 for pressing the pressure belt 66 towards the heating roll 64 is disposed at the inner periphery side of the pressure belt 66, along the rotation axis direction of the pressure belt 66.

The pressing member 80 includes a pressing body 82 disposed at the heating roll 64 side, the plate body 84 provided to the pressing body 82 and L-shaped in side view, and a membrane body 86 attached to the pressing body 82.

Figure 6:
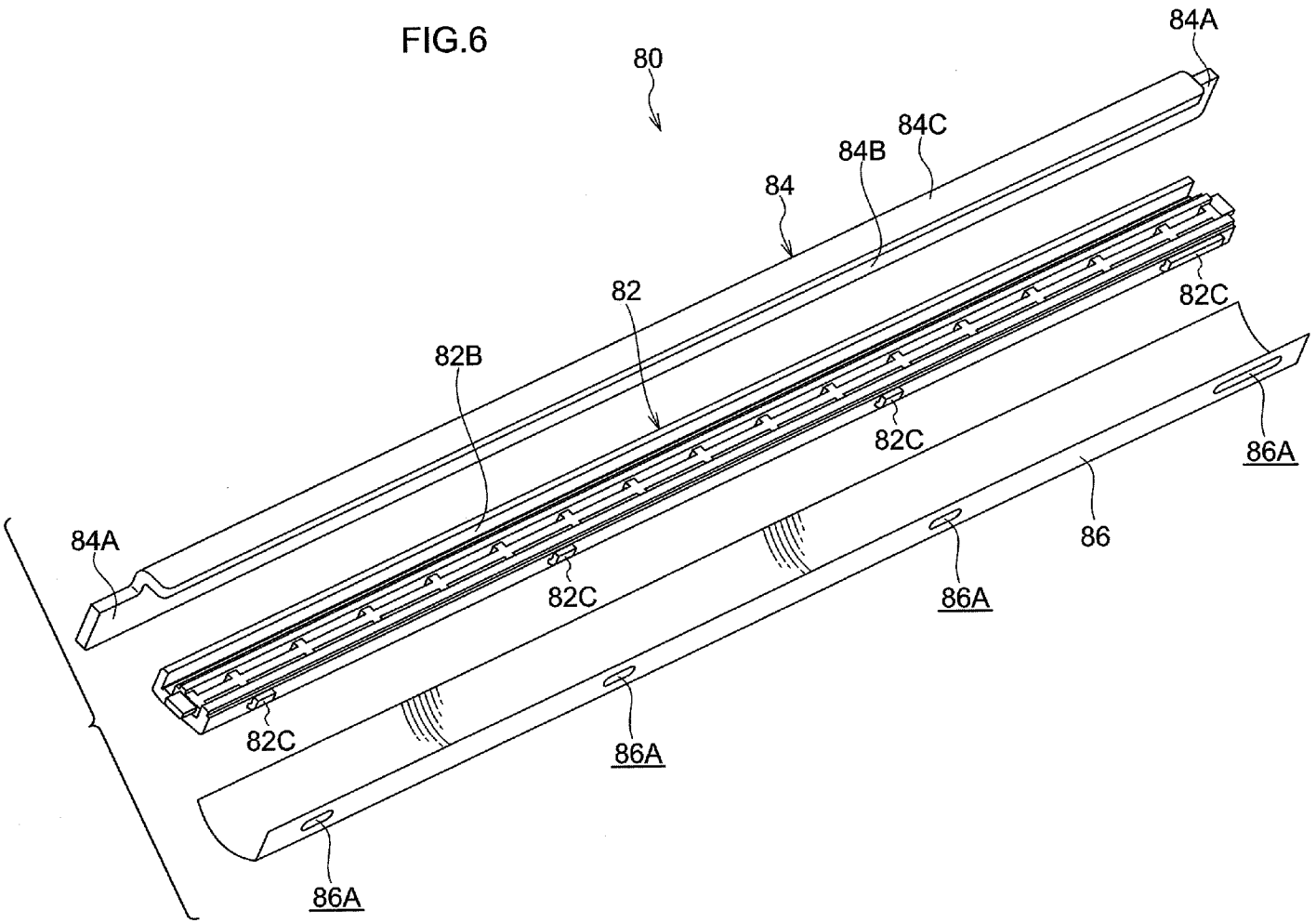
FIG. 6 is an exploded perspective view of a pressing member according to the present exemplary embodiment.
Figure 7:
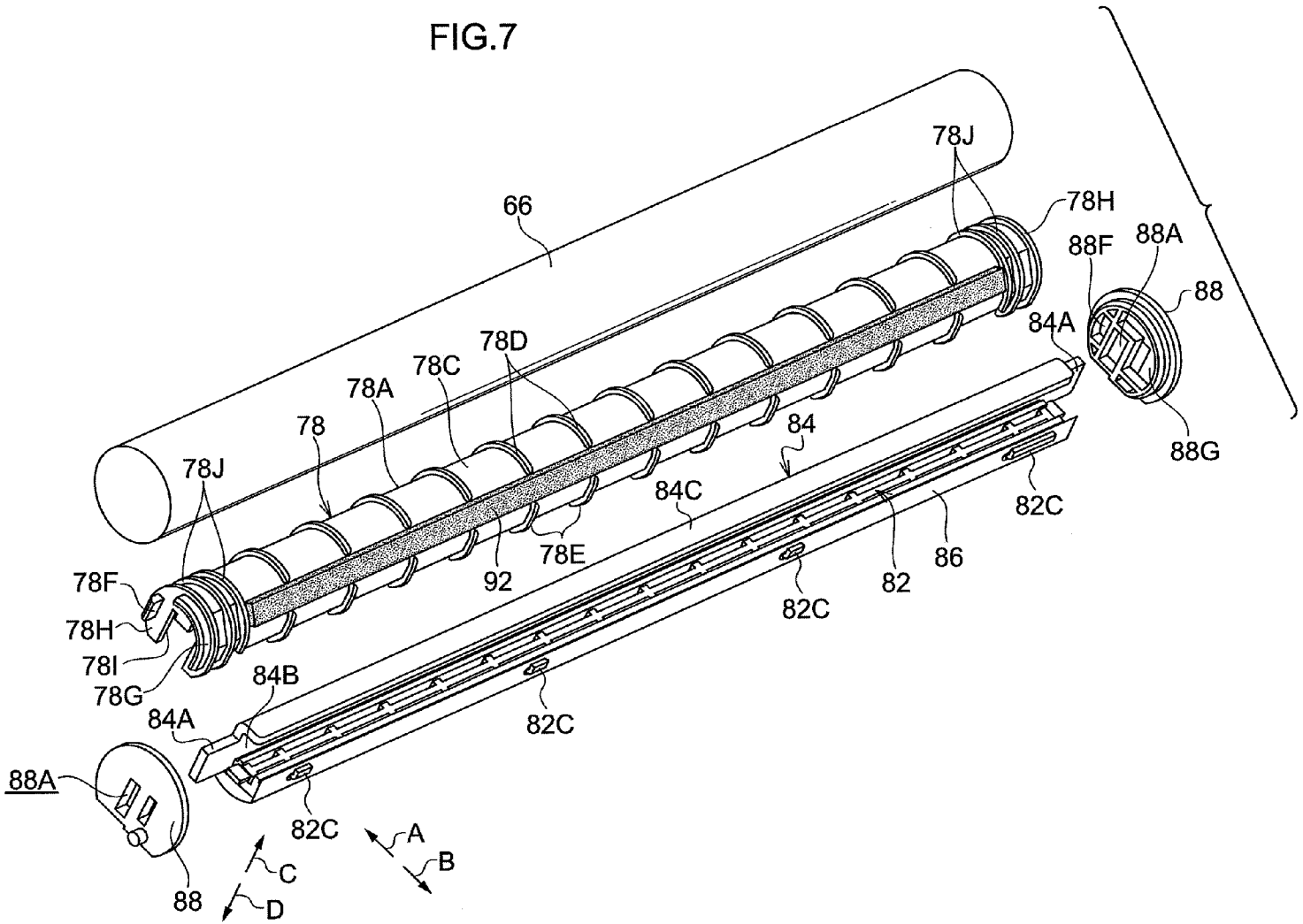
FIG. 7 is a perspective view showing a configuration of a pressure belt, a contact member, a restricting member and a pressing member according to the present exemplary embodiment.

The pressing body 82, as shown in FIG. 6 and FIG. 7, has its length running along the rotation axis direction of the pressure belt 66, and is also formed in a substantially rectangular shape (block shape) in side view, as shown in FIG. 5. An opposing face 82A is formed at the heating roll 64 side (the left hand bottom side in FIG. 5) of the pressing body 82, facing the heating roll 64 with the pressure belt 66 and the membrane body 86 therebetween. The opposing face 82A functions as a pressing face for pressing towards the heating roll 64.

An insertion groove 82B is formed along the length direction of the pressing body 82 at the side (the right hand top side in FIG. 5) of the pressing body 82 distanced from the heating roll 64 (see FIG. 6). The insertion groove 82B is inserted into by the plate body 84. As shown in FIG. 5, the insertion groove 82B is disposed at the pressure belt 66 rotation direction downstream side (the left hand top side in FIG. 5) of the pressing body 82. Since the pressing body 82 is imparted with pressing force from the plate body 84 inserted into the insertion groove 82B, the pressing force of the opposing face 82A against the heating roll 64 is greatest at the portion where the insertion groove 82B is disposed.

Hooks 82C are provided at the pressure belt 66 rotation direction upstream side (the right hand bottom side in FIG. 5) of the pressing body 82, the hooks 82C serving as examples of attaching portions to which the membrane body 86 is attached. Plural of the hooks 82C are provided at the side face of the pressing body 82 (see FIG. 6) along the length direction of the pressing body 82.

The plate body 84, as shown in FIG. 7, has its length direction running along the pressure belt 66 rotation axis direction. As shown in FIG. 5, the plate body 84 is, in side view, configured including a plate portion 84B extending from the right hand top side towards the left hand bottom side in FIG. 5, and a plate portion 84C extending from the side of the plate portion 84B distanced from the pressing body 82 (the right hand top side of FIG. 5) to the right hand bottom side in FIG. 5. The leading end of the plate portion 84B at the heating roll 64 side is configured so as to be inserted into the insertion groove 82B of the pressing body 82.

As shown in FIG. 6, the projecting portions 84A are formed at both length direction ends of the plate portion 84B, projecting further in the length direction to the outside than the plate portion 84C.

The membrane body 86, as shown in FIG. 7, has its length direction running along the pressure belt 66 rotation axis direction. The membrane body 86 is formed with attachment holes 86A, serving as examples of attached portions, to which the hooks 82C of the pressing body 82 are attached. The attachment holes 86A of the membrane body 86 are attached to by the hooks 82C of the pressing body 82 and the membrane body 86 is disposed between the opposing face 82A of the pressing body 82 and the inner peripheral face of the pressure belt 66.

As shown in FIG. 5, a contact member 78 that makes sliding contact with the rotating pressure belt 66 is disposed along the pressure belt 66 rotation axis direction at the inner periphery side of the pressure belt 66. As shown in FIG. 7, the contact member 78 has a length direction running along the rotation axis direction of the pressure belt 66, and also, as shown in FIG. 5, has a peripheral wall 78A formed along a portion of the circumferential direction of the pressure belt 66. Specifically, the contact member 78 is formed running along the circumferential direction of the pressure belt 66 excluding a portion at the heating roll 64 side (the left hand bottom side in FIG. 5). The contact member 78 is thereby open at the heating roll 64 side (the left hand bottom side in FIG. 5), and a housing space 78B is formed at the inner peripheral side of the peripheral wall 78A, capable of housing the pressing member 80.

As shown in FIG. 7, first ribs 78D, serving as examples of first protrusion portions, are formed on the outer peripheral face 78C of the peripheral wall 78A along the circumferential direction of the peripheral wall 78A (the pressure belt 66 rotation direction). Plural of the first ribs 78D are disposed at intervals along the length direction of the peripheral wall 78A.

Second ribs 78E, serving as examples of second protrusion portions, are formed on the outer peripheral face 78C of the peripheral wall 78A, along the circumferential direction of the peripheral wall 78A (the pressure belt 66 rotation direction) so as to be spaced apart from the first ribs 78D in the circumferential direction of the peripheral wall 78A (the pressure belt 66 rotation direction). Plural second ribs 78E are disposed at intervals along the length direction of the peripheral wall 78A.

An impregnated member 92 impregnated with a lubricating oil, serving as an example of a lubrication agent, is disposed on the outer peripheral face 78C of the peripheral wall 78A between the first ribs 78D and the second ribs 78E. The impregnated member 92 is, for example, configured from sponge or felt. The impregnated member 92 has its length direction running along the pressure belt 66 rotation axis direction, and is formed in a substantially rectangular shape.

Third ribs 78J are formed at the length direction outside of the impregnated member 92 at both length direction ends of the peripheral wall 78A, respectively. The third ribs 78J are formed along the circumferential direction of the peripheral wall 78A (the pressure belt 66 rotation direction). Configuration is made such that there is sliding contact of the inner peripheral face of the pressure belt 66 against the third ribs 78J, the second ribs 78E, the first ribs 78D and the impregnated member 92.

Side walls 78H are provided at both length direction ends of the peripheral wall 78A. Cutouts 781 are cut out and formed in the heating roll 64 side of the respective side walls 78H. In a state in which the pressing member 80 is housed in the housing space 78B of the contact member 78, the projecting portions 84A of the plate body 84 are configured to project out to the outside from the cutouts 781 of the side walls 78H. At the outside face of each of the side walls 78H, a projection 78F and a projection 78G are formed projecting out to the outside in the length direction of the contact member 78. The projection 78F extends, in side view, along the plate portion 84B and projecting portions 84A of the plate body 84. The projection 78G is formed along the outer peripheral face 78C of the peripheral wall 78A.

Restricting members 88 are provided at the side wall 78H sides of the contact members 78, for restricting movement of the pressure belt 66 along the rotation axis direction thereof. The face at the side walls 78H side of each of the restricting members 88 is formed with a recess 88F and a recess 88G, into which the projection 78F and the projection 78G of the side walls 78H are inserted. An insertion hole 88A is formed in each of the side walls 78H, for insertion into by the respective projecting portion 84A of the plate body 84. The restricting members 88 are mounted to the contact member 78 by the projection 78F and the projection 78G of the side walls 78H being inserted into the recess 88F and the recess 88G, and by the projecting portions 84A of the plate body 84 being inserted into the insertion holes 88A. When mounted to the contact member 78, the restricting members 88 are configured so as to jut out further to the radial direction outside than the outer peripheral surface of the contact member 78. Accordingly, when the pressure belt 66 moves in the pressure belt 66 rotation axis directions, the restricting members 88 contact the side edges of the pressure belt 66, and restrict further movement of the pressure belt 66 in the rotation axis direction.

In the present exemplary embodiment, in a state in which the pressing member 80 is housed in the housing space 78B of the contact member 78, the contact member 78 is inserted through the internal space of the pressure belt 66. The projecting portions 84A of the plate body 84 of the pressing member 80, which has been inserted through the internal space of the pressure belt 66, are inserted into the insertion holes 88A of the restricting members 88, and the projection 78F and the projection 78G of the side walls 78H of the contact member 78 are also inserted into the recesses 88F and the recesses 88G of the restricting members 88. The pressure belt 66 is supported by the belt support member 76 by the projecting portions 84A of the plate body 84 being inserted into the insertion grooves 76B of the pair of side plates 76A of the belt support member 76. Furthermore, load is imparted at both pressure belt 66 rotation axis direction ends of the pressing member 80, due to the pair of side plates 76A of the belt support member 76 and the pair of side plates 74A of the roll support member 74 being pulled by tension of the tension springs 90, and the pressing member 80 presses the pressure belt 66 towards the heating roll 64.

Due thereto, the pressure belt 66 is rotatably supported on the fixing device body 62 by the belt support member 76 at a position facing the heating roll 64. Configuration of the heating roll 64 and the pressure belt 66 is made such that the heating roll 64 is rotationally driven, and the pressure belt 66 undertakes rotation following the rotation of the heating roll 64, with the recording medium P, onto which the toner image has been transferred, being nipped between the heating roll 64 and the pressure belt 66 and conveyed.

In the present exemplary embodiment, in a state in which the pressing member 80, supported by the pair of side plates 76A, is housed in the housing space 78B of the contact member 78, a gap is formed between the pressing member 80 and the inside face of the side walls 7811. Accordingly, in a state in which the pressing member 80 is housed in the housing space 78B, the contact member 78 is able to move in the length direction relative to the pressing member 80 within a range of movement restricted by the inside face of the side walls 78H making contact with the pressing member 80. Movement restriction of the contact member 78 is, for example, when the inside face of the peripheral wall 78A makes contact with the end face of the plate portion 84C of the plate body 84.

In a state in which the pressing member 80, supported by the pair of side plates 76A, is housed in the housing space 78B of the contact member 78, a gap is formed between the pressing member 80 (for example, the side face of the pressing body 82) and the inside face of the peripheral wall 78A. Accordingly, in the state in which the pressing member 80 is housed in the housing space 78B, the contact member 78 is able to move in the arrow A direction and the arrow B direction, shown in FIG. 5 and FIG. 7, within a range of movement restricted by the inside face of the peripheral wall 78A making contact with the pressing member 80.

Tilted movement is possible, with one length direction end of the contact member 78 moving towards the arrow A direction (or the arrow B direction) side shown in FIG. 5 and FIG. 7, and the other length direction end of the contact member 78 moving towards the arrow B direction (or the arrow A direction) side shown in FIG. 5 and FIG. 7.

In a state in which the pressing member 80, supported by the pair of side plates 76A, is housed in the housing space 78B of the contact member 78, movement is possible in the arrow C direction and the arrow D direction shown in FIG. 5 and FIG. 7 between the pressing member 80 and the inner peripheral face of the pressure belt 66. The contact member 78 is also able to undertake tilted movement along the pressure belt 66 rotation direction within a range of movement restricted by contact with the pressing member 80.

Consequently, in the state in which the pressure belt 66 is supported by the belt support member 76, the contact member 78 is supported so as to be independently displaceable relative to the pressing member 80.

When the restricting members 88 is in a mounted state to the side walls 78H of the contact member 78, gaps are formed between the inner wall of the recess 88F and the recess 88G and the projections 78F and the projections 78Q respectively, of the contact member 78. In a state in which the projecting portions 84A of the plate body 84 are inserted into the insertion holes 88A of the restricting members 88, gaps are formed between the inner wall of the insertion holes 88A and the projecting portions 84A of the plate body 84.

Accordingly, the restricting members 88 is able to move relative to the pressing member 80 and the contact member 78, within a range of movement restricted by the projection 78F and the projection 78G and the projecting portions 84A, in the arrow A direction and the arrow B direction of FIG. 5 and FIG. 7, and in the arrow C direction and the arrow D direction shown in FIG. 5 and FIG. 7. The restricting members 88 are also able to tilt along the pressure belt 66 rotation direction, within a range restricted by the projection 78F, the projection 78G and the projecting portions 84A.

Furthermore, the restricting members 88 are capable of moving in the pressure belt 66 rotation axis direction, along the projecting portions 84A of the plate body 84, between the side walls 78H of the contact member 78 and the side plates 76A of the belt support member 76.

Consequently, when the pressure belt 66 is in a supported state by the belt support member 76, the restricting members 88 are supported so as to be independently displaceable relative to the contact member 78 and the pressing member 80.

In the present exemplary embodiment, the contact member 78 and the restricting members 88 are configured so as not to be directly supported by the belt support member 76, however, configuration may be made such that the contact member 78 and the restricting members 88 are in a directly supported state, with some play therebetween, by the belt support member 76.

The projecting portions 84A of the plate body 84 are inserted without gaps to the respective insertion grooves 76B of the pair of side plates 76A, and the pressing member 80 is supported by the belt support member 76 in a state with no play to the belt support member 76.

Operation According to the Present Exemplary Embodiment

Next, explanation follows regarding operation according to the present exemplary embodiment.

In the present exemplary embodiment, the recording medium P, onto which a toner image has been transferred from the intermediate transfer belt 24 at the secondary transfer position, is fed in between the heating roll 64 and the pressure belt 66. The recording medium P that has been fed in between the heating roll 64 and the pressure belt 66 has heat imparted to the toner on the recording medium P by the heating roll 64, and has pressure imparted to the toner on the recording medium P by the pressure belt 66, while being nipped between the heating roll 64 and the pressure belt 66 and conveyed, and the image is thereby fixed onto the recording medium P.

In the present exemplary embodiment, the contact member 78 is independently displaceable relative to the pressing member 80, and the restricting members 88 are independently displaceable relative to the contact member 78 and the pressing member 80. Accordingly, for example, when the pressure belt 66 rotates while tilted relative to the length direction of the pressing member 80 due to the rotational center of the pressure belt 66 being tilted relative to the rotational center of the heating roll 64, the contact member 78 displaces to follow the tilt of the pressure belt 66 due to the contact pressure of the pressure belt 66 against the contact member 78. Due to displacement of the contact member 78, the restricting members 88 also displace, pressed by the side walls 78H, the projection 78F and the projection 78G of the contact member 78. The restricting members 88 also displace independently of the contact member 78 due to being pressed by the side edges of the pressure belt 66.

Accordingly, localized contact of the contact member 78 and the impregnated member 92 to the inner periphery of the pressure belt 66 is suppressed. The restricting members 88 are also suppressed from localized contact with the side edges of the pressure belt 66.

Consequently, since unbalanced force does not act on the pressure belt 66 from the contact member 78 and the impregnated member 92, abrasion of the pressure belt 66 and snaking of the pressure belt 66 is suppressed. Due to unbalanced force not acting on the pressure belt 66, positioning precision of the pressure position where the pressure belt 66 presses the heating roll 64 is raised.

Since localized contact of the impregnated member 92 against the inner periphery of the pressure belt 66 is suppressed, collapse of the impregnated member 92 is suppressed, and there is little change in the tensioning force of the pressure belt 66 due to the impregnated member 92.

In the present exemplary embodiment, the impregnated member 92 is disposed between the first ribs 78D and the second ribs 78E. Accordingly, the first ribs 78D and the second ribs 78E suppress contact of the pressure belt 66 onto the impregnated member 92, and therefore the impregnated member 92 is suppressed from making localized contact with the inner periphery of the pressure belt 66. Due thereto, abrasion of the pressure belt 66 and snaking of the pressure belt 66 is suppressed. Due to unbalanced force not acting on the pressure belt 66, positioning precision of the pressure position where the pressure belt 66 presses the heating roll 64 is raised. Collapse of the impregnated member 92 is also suppressed, and there is little change in the tensioning force of the pressure belt 66 from the impregnated member 92.

Since the restricting members 88 is suppressed from making localized contact with the side edges of the pressure belt 66, damage to the side edges of the pressure belt 66 is also suppressed.

Since the length direction ends of the contact member 78 are not supported by the belt support member 76, the degrees of freedom for design in the shape of the contact member 78 are increased, such as adopting a shape close to a circular shape at the external diameter so as to follow the contours of the pressure belt 66.

Even when, as the recording medium P, material having a narrow width along the rotation axis direction of the heating roll 64 and the pressure belt 66 and a thick thickness, such as, for example, an envelope or the like, is introduced between the heating roll 64 and the pressure belt 66, since the pressure belt 66 displaces together with the contact member 78 due to force acting from the recording medium P, insertion orientation of the recording medium P is stabilized.

The present invention is not limited to the exemplary embodiments described above, and various variations, modifications and improvements are possible. For example, configuration may be made with a heat source disposed inside the pressure belt 66, and the pressure belt 66 employed as a heating belt. In such a configuration, the heating roll 64 may also be employed as a press roll. In a configuration in which the pressure belt 66 is employed as a heating belt, the placement positions of the pressure belt 66 and the heating roll 64 may be swapped over.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A conveying device comprising:

a rotating body that rotates;

a conveying belt that rotates while nipping a conveyed member between the conveying belt and the rotating body, thereby conveying the conveyed member;

a pressing member that is disposed at an inner periphery of the conveying belt along a conveying belt rotation axis direction and presses the conveying belt towards the rotating body;

a pair of support members that are respectively disposed at each of two rotation axis direction edge sides of the conveying belt and that support the pressing member; and a contact member that is disposed at the inner periphery of the conveying belt along the conveying belt rotation axis direction, makes sliding contact with the rotating conveying belt, and is supported so as to be independently displaceable, in a state in which the conveying belt rotates, relative to the pressing member.

2. The conveying device of claim 1, further comprising a restricting member that is disposed at each of the conveying belt rotation axis direction end sides of the contact member, that contacts side edges of the conveying belt, thereby restricting movement of the conveying belt in the rotation axis direction, and that is supported independently displaceable with respect to the pressing member and the contact member.

3. The conveying device of claim 1, further comprising:

first protrusion portions that are formed on an outer peripheral surface of the contact member along the conveying belt rotation direction and make sliding contact with the rotating conveying belt;

second protrusion portions that are formed on the outer peripheral surface of the contact member along the conveying belt rotation direction, spaced apart from the first protrusion portions, and that make sliding contact with the rotating conveying belt; and an impregnated member that is disposed on the outer peripheral surface of the contact member between the first protrusion portions and the second protrusion portions, and that makes sliding contact with the rotating conveying belt and is impregnated with a lubrication agent.

4. A fixing device comprising:

the conveying device of claim 1, wherein at least one of the rotating body or the conveying belt is provided with a heating source, and an image is fixed to a recording medium at a contact region of the rotating body and the conveying belt.

5. An image forming apparatus comprising:

an image forming section that forms an image on a recording medium; and the fixing device of claim 4 that fixes the image formed by the image forming section onto the recording medium.

6. The conveying device of claim 2, wherein the contact member displaces to follow the tilt of the conveying belt; and wherein the restricting member is suppressed from contacting an inner periphery of the conveying belt.

* * * * *